US007080937B1

(12) United States Patent
Salmela et al.

(10) Patent No.: US 7,080,937 B1
(45) Date of Patent: Jul. 25, 2006

(54) NONCLOGGING STATIC MIXER

(75) Inventors: Juha K. Salmela, Citrus Heights, CA (US); Bret Baker, Vacaville, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 218 days.

(21) Appl. No.: 10/713,228

(22) Filed: Nov. 13, 2003

(51) Int. Cl.
*B01F 5/00* (2006.01)

(52) U.S. Cl. ..... 366/341

(58) Field of Classification Search ..... 366/336–338, 366/340, 341
See application file for complete search history.

(56) References Cited

U.S. PATENT DOCUMENTS

| | | | | | |
|---|---|---|---|---|---|
| 3,459,407 | A | * | 8/1969 | Hazlehurst et al. | 366/338 |
| 3,476,521 | A | * | 11/1969 | Wise | 422/138 |
| 3,831,904 | A | * | 8/1974 | Appeldoom et al. | 366/337 |
| 4,222,671 | A | * | 9/1980 | Gilmore | 366/337 |
| 4,316,673 | A | * | 2/1982 | Speer | 366/337 |
| 4,511,258 | A | | 4/1985 | Federighi et al. | |
| 4,936,689 | A | | 6/1990 | Federighi et al. | |
| 5,595,712 | A | * | 1/1997 | Harbster et al. | 422/129 |
| 5,758,967 | A | | 6/1998 | King | |
| 5,826,981 | A | * | 10/1998 | Fowler et al. | 366/337 |
| 6,105,880 | A | | 8/2000 | Bazil et al. | |
| 6,467,949 | B1 | | 10/2002 | Reeder et al. | |
| 6,595,679 | B1 | | 7/2003 | Schuchardt | |

* cited by examiner

*Primary Examiner*—David Sorkin
(74) *Attorney, Agent, or Firm*—Townsend and Townsend and Crew LLP

(57) ABSTRACT

In one embodiment, a mixing apparatus for mixing a flowable material comprises a first body having a first mating surface and a plurality of first cavities formed on the first mating surface. The plurality of first cavities are arranged along a first path to provide a variation in depth measured from the first mating surface. A second body has a second mating surface configured to mate with the first mating surface of the first body. The second body includes a plurality of second cavities formed on the second mating surface. The plurality of second cavities are arranged along a second path to provide a variation in depth measured from the second mating surface. The first mating surface of the first body is mated with the second mating surface of the second body to align the first path with the second path. The first cavities fluidicly communicates with the second cavities to form an internal flow path from an inlet through the first cavities and second cavities to an outlet. The internal flow path has multiple depth turns to direct flow between the first body and the second body formed by the depth variations in the first cavities of the first body and the second cavities in the second body.

20 Claims, 1 Drawing Sheet

NONCLOGGING STATIC MIXER

CROSS-REFERENCES TO RELATED APPLICATIONS

NOT APPLICABLE

BACKGROUND OF THE INVENTION

The present invention relates generally to mixing apparatus and, more particularly, to a static mixing apparatus configured to avoid clogging by particulates or the like contained in the materials being mixed.

It is often desirable to dispense a condiment, a beverage, or the like by consistent amounts. There is substantial savings realized in the food industry in the shipping cost of concentrated products. In some cases, the mix ratio is high, such as 50/50 sauce to water ratio for mixing concentrated pizza sauce. The cost savings in shipping for such cases can be substantial. Conventional mixing devices may not work well for mixing materials having particulates such as seeds, tomato skins, and various seasoning product with stringy particulates in pizza sauce or the like due to clogging. Some mixing devices may be difficult to clean and maintain, especially when clogging occurs. For sanitary reasons, the mixing device should be cleaned quickly and completely after each use. Clogging by the particulates is one of the difficulties that need to be overcome.

BRIEF SUMMARY OF THE INVENTION

Embodiments of the present invention are directed to a mixing apparatus for mixing a sauce or the like containing particulates which is configured to reduce or prevent clogging of the apparatus by the particulates. The internal mixing flow path is formed by mating two bodies having cavities formed on the mating surfaces. The two bodies can be manufactured inexpensively and assembled easily. The mixing apparatus employs surfaces having a smooth finish for the mixing flow path that includes multiple turns and size changes which generate aggressive pulsations to achieve good mixing and provide a consistent homogeneous mixture with minimum clogging. In specific examples, the mixing flow path has up to more than 20 turns of 90°, 180°, and the like. The mixing flow path size and the number of turns are configured for a given sauce or product to be mixed to keep the pressure drop across the mixing apparatus at a minimum and still achieve the desired mixing result. The surfaces of the mixing flow path preferably have a smooth finish with substantially no cracks and crevices that are visible to the human eye, and hence are easier to clean quickly and completely after each use. The conventional thinking that rough surface finish would help mixing is discounted here for the sanitary reasons stated above.

In accordance with an aspect of the present invention, a mixing apparatus for mixing a flowable material comprises a first body having a first mating surface and a plurality of first cavities formed on the first mating surface. The plurality of first cavities are arranged along a first path to provide a variation in depth measured from the first mating surface. A second body has a second mating surface configured to mate with the first mating surface of the first body. The second body includes a plurality of second cavities formed on the second mating surface. The plurality of second cavities are arranged along a second path to provide a variation in depth measured from the second mating surface. The first mating surface of the first body is mated with the second mating surface of the second body to align the first path with the second path. The first cavities fluidicly communicate with the second cavities to form an internal flow path from an inlet through the first cavities and second cavities to an outlet. The internal flow path has multiple depth turns to direct flow between the first body and the second body formed by the depth variations in the first cavities of the first body and the second cavities in the second body.

In some embodiments, the first cavities are spaced from each other along the first path by first regions of zero depth measured from the first mating surface. The second cavities are spaced from each other along the second path by second regions of zero depth measured from the second mating surface. The first regions of zero depth of the first path and the second regions of zero depth of the second path are staggered along the internal flow path. The multiple depth turns are spaced by substantially regular intervals. The first mating surface and the second mating surface are generally planar. The plurality of first cavities comprise at least one first cavity having a surface turn on the first mating surface. The surface turn is about 90°. The first mating surface is bonded to the second mating surface. The surfaces of the internal flow path are substantially free of cracks and crevices visible to human eye.

In accordance with another aspect of the invention, a mixing apparatus for mixing a flowable material comprises a first shell having a first mating surface and a plurality of first cavities formed on the first mating surface. The plurality of first cavities are arranged along a first path to provide a variation in depth measured from the first mating surface. A second shell has a second mating surface configured to mate with the first mating surface of the first shell. The second shell includes a plurality of second cavities formed on the second mating surface. The plurality of second cavities are arranged along a second path to provide a variation in depth measured from the second mating surface. The first mating surface of the first shell is mated with the second mating surface of the second shell to align the first path with the second path. The first cavities fluidicly communicate with the second cavities to form an internal flow path from an inlet through the first cavities and second cavities to an outlet. The first cavities are spaced from each other along the first path by regions of shallow depth from the first mating surface. The second cavities are spaced from each other along the second path by regions of shallow depth from the second mating surface. The first regions of shallow depth of the first mating surface and the second regions of shallow depth are staggered along the internal flow path.

In some embodiments, the first regions of shallow depth and the second regions of shallow depth comprise regions of zero depth. The first regions of shallow depth of the first mating surface and the second regions of shallow depth are staggered along the internal flow path at substantially regular intervals.

In accordance with another aspect of the present invention, a method of making a mixing apparatus for mixing a flowable material comprises providing a first body having a first mating surface and a plurality of first cavities formed on the first mating surface, the plurality of first cavities being arranged along a first path to provide a variation in depth measured from the first mating surface; and providing a second body having a second mating surface configured to mate with the first mating surface of the first body, the second body including a plurality of second cavities formed on the second mating surface, the plurality of second cavities being arranged along a second path to provide a variation in depth measured from the second mating surface. The first mating surface of the first body is mated with the second mating surface of the second body to align the first path with the second path. The first cavities fluidicly communicate with the second cavities to form an internal flow path from an inlet through the first cavities and second cavities to an outlet. The internal flow path has multiple depth turns to direct flow between the first body and the second body formed by the depth variations in the first cavities of the first body and the second cavities in the second body.

DETAILED DESCRIPTION OF THE INVENTION

Figure 2:
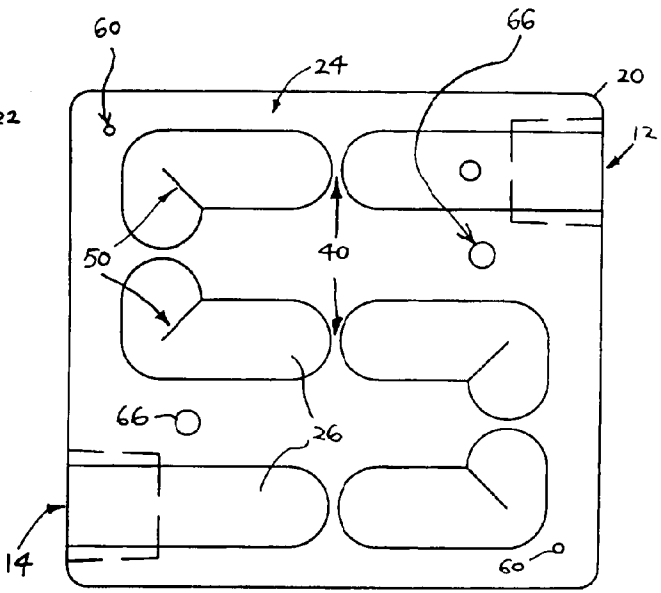
FIG. 2 is a side view of the first body of the mixing apparatus of FIG. 1 along line 2—2.
Figure 1:
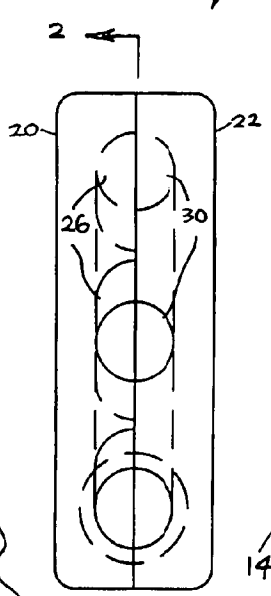
FIG. 1 is a front elevational view of a mixing apparatus according to an embodiment of the present invention.
Figure 3:
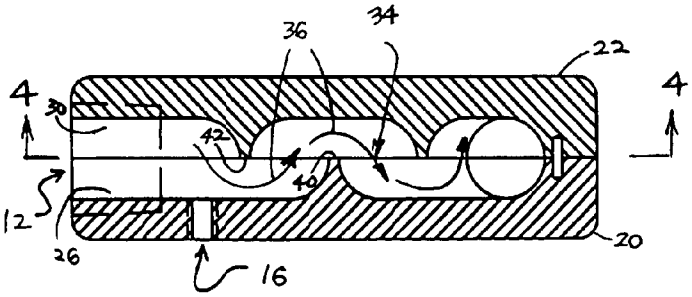
FIG. 3 is a cross-sectional plan view of the mixing apparatus of FIG. 1.
Figure 4:
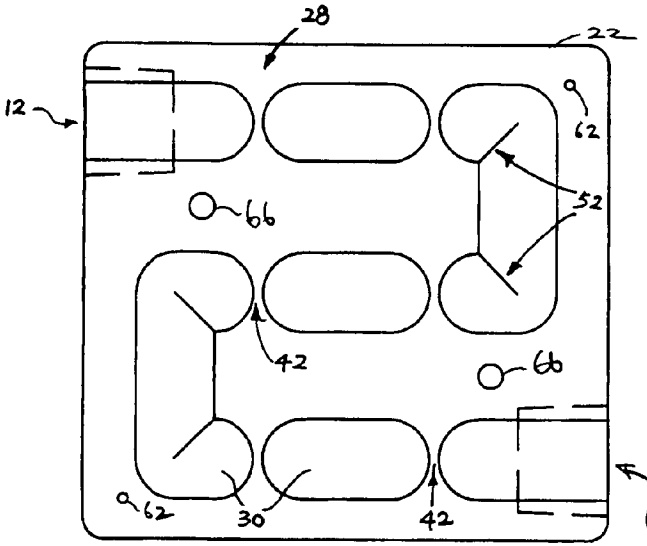
FIG. 4 is a side view of the second body of the mixing apparatus of FIG. 3 along line 4—4.

FIGS. 1–4 show a mixing apparatus 10 including an internal flow path having an inlet 12 and an outlet 14. A second inlet 16 may be provided for introducing a second material to be mixed with a first material to be introduced through the first inlet 12. The mixing apparatus 10 is a static device with no moving parts. The mixing apparatus 10 is formed from a first body or shell 20 and a second body or shell 22. The first body 20 includes a first mating surface 24 and a plurality of first cavities 26 formed on the first mating surface 24. The plurality of first cavities 26 are arranged along a first path to provide a variation in depth measured from the first mating surface 24. As seen in FIG. 2, the first path has the shape of an "S." The second body 22 includes a second mating surface 28 and a plurality of second cavities 30 formed on the second mating surface 28. The plurality of second cavities 30 are arranged along a second path to provide a variation in depth measured from the second mating surface 28. As seen in FIG. 4, the second path has the shape of a reverse "S." The first mating surface 24 and the second mating surface 28 are generally planar in the specific embodiment shown. The cavities 26, 30 are generally semi-circular in cross-section, but may have other shapes in other embodiments.

When the first mating surface 24 is mated with the second mating surface 28, the S-shaped first path is aligned with the reverse-S-shaped second path. The mating surfaces 24, 28 form an interface 34 which may be a bond plane. The first cavities 26 fluidicly communicate with the second cavities 30 to form the internal flow path from the inlet 12 through the cavities 26, 30 to the outlet 14. The internal flow path has multiple depth turns as indicated by arrows 36 in FIG. 3. The depth turns 36 direct the flow between the first body 20 and the second body 22 or, more particularly, between the first cavities 26 and the second cavities 30, to turn by about 180°. The depth turns 36 are formed by the depth variations in the first cavities 26 of the first body 20 and the second cavities 30 of the second body 22.

The first cavities 26 are spaced from each other along the first path by first regions 40 of shallow depth measured from the first mating surface 24, as shown in FIG. 2. The second cavities 30 are spaced from each other along the second path by second regions 42 of shallow depth measured from the second mating surface 28, as seen in FIG. 4. For example, the shallow depth regions 40, 42 may have depths that are small fractions (e.g., <10%) of the depths of the cavities 26, 30. In the specific embodiment shown in FIG. 3, the first regions 40 and second region 42 have zero depth. The first regions 40 and second regions 42 of shallow depth form the multiple depth turns 36. As shown in FIGS. 1–4, the first regions 40 of shallow depth and the second regions 42 of shallow depth are staggered along the internal flow path, desirably at substantially regular intervals. In this way, the multiple depth turns 36 are spaced by substantially regular intervals. In addition, the first cavities 26 may include surface turns 50 on the first mating surface 24, and the second cavities 30 may include surface turns 52 on the second mating surface 28. The surface turns are about 90° as shown, but may form different angles in other embodiments. The depth turns 36, alone or in combination with the surface turns 50, 52, generate aggressive pulsations from periodic size changes of the mixing flow path and variation in flow direction to provide excellent mixing results with a minimum number of turns.

The first body 20 and second body 22 may be made from a variety of materials, and then joined together to form the mixing apparatus 10. For example, the bodies 20, 22 may be machined from blocks of food grade clear acrylic and bonded together. Alternatively, the bodies 20, 22 may be made by injection molding and joined together by ultrasonic welding to minimize machining. To facilitate easy assembly of the bodies 20, 22, alignment pins 60 and alignment apertures 62 are used to align the bodies 20, 22, and mounting holes 66 are used to attach the bodies 20, 22 using fasteners or the like. In other embodiments, the locating apertures and pins may be replaced by locating dimples and domes. The inlet 12 and outlet 14 may be machined or molded to provide threads to receive threaded fittings.

The clam shell type construction of the mixing apparatus 10 is relatively easy and inexpensive to manufacture, and does not require expensive and complicated procedures for locating and mounting numerous mixing element components. The two bodies 20, 22 can be made by CNC machining or injection molding or the like, and joined together by solvent bonding or ultrasonic welding or the like. Moreover, the surfaces of the internal mixing flow path preferably have a smooth finish with substantially no cracks and crevices that are visible to the human eye. There are desirably no sharp and impinging corner points in the internal flow path. As a result, the internal flow path is easier to clean quickly and completely after each use by flowing a cleaning fluid therethrough.

The above-described arrangements of apparatus and methods are merely illustrative of applications of the principles of this invention and many other embodiments and modifications may be made without departing from the spirit and scope of the invention as defined in the claims. For example, the mixing apparatus may be formed by more than two bodies. The mating surfaces may be nonplanar. The scope of the invention should, therefore, be determined not with reference to the above description, but instead should be determined with reference to the appended claims along with their full scope of equivalents.

What is claimed is:

1. A mixing apparatus for mixing a flowable material, the mixing apparatus comprising:

a first body having a first mating surface and a plurality of first cavities formed on the first mating surface, the plurality of first cavities being arranged along a first path to provide a variation in depth measured from the first mating surface; and a second body having a second mating surface configured to mate with the first mating surface of the first body, the second body including a plurality of second cavities formed on the second mating surface, the plurality of second cavities being arranged along a second path to provide a variation in depth measured from the second mating surface;

wherein the first mating surface of the first body is mated with the second mating surface of the second body to align the first path with the second path, the first cavities fluidicly communicating with the second cavities to form an internal flow path from an inlet through the first cavities and second cavities to an outlet, the internal flow path having multiple depth turns to direct flow between the first body and the second body formed by the depth variations in the first cavities of the first body and the second cavities in the second body;

wherein the first cavities are spaced from each other along the first path by first regions of zero depth measured from the first mating surface;

wherein the second cavities are spaced from each other along the second path by second regions of zero depth measured from the second mating surface; and wherein the plurality of first cavities comprise at least one first cavity having a first surface turn on the first mating surface to direct flow to turn at an angle along the first surface turn, and wherein the plurality of second cavities comprise at least one second cavity having a second surface turn on the second mating surface to direct flow to turn at an angle along the second surface turn.

2. The mixing apparatus of claim 1 wherein the multiple depth turns are spaced by substantially regular intervals.

3. The mixing apparatus of claim 1 wherein the first mating surface and the second mating surface are generally planar.

4. The mixing apparatus of claim 1 wherein the first surface turn is about 90° and the second surface turn is about 90°.

5. The mixing apparatus of claim 1 wherein the first mating surface is bonded to the second mating surface.

6. The mixing apparatus of claim 1 wherein the surfaces of the internal flow path are substantially free of cracks and crevices visible to human eye.

7. The mixing apparatus of claim 1 wherein the first regions of zero depth of the first path and the second regions of zero depth of the second path are staggered along the continuous internal flow path, such that the first regions of zero depth of the first path of the first body overlap with the second cavities of the second body, and the second regions of zero depth of the second path of the second body overlap with the first cavities of the first body.

8. A mixing apparatus for mixing a flowable material, the mixing apparatus comprising:

a first shell having a first mating surface and a plurality of first cavities formed on the first mating surface, the plurality of first cavities being arranged along a first path to provide a variation in depth measured from the first mating surface; and a second shell having a second mating surface configured to mate with the first mating surface of the first shell, the second shell including a plurality of second cavities formed on the second mating surface, the plurality of second cavities being arranged along a second path to provide a variation in depth measured from the second mating surface;

wherein the first mating surface of the first shell is mated with the second mating surface of the second shell to align the first path with the second path, the first cavities fluidicly communicating with the second cavities to form an internal flow path from an inlet through the first cavities and second cavities to an outlet, the first cavities being spaced from each other along the first path by regions of shallow depth from the first mating surface, the second cavities being spaced from each other along the second path by regions of shallow depth from the second mating surface, the first regions of shallow depth of the first mating surface and the second regions of shallow depth being staggered along the internal flow path, wherein the plurality of first cavities comprise at least one first cavity having a first surface turn on the first mating surface to direct flow to turn at an angle along the first surface turn, and wherein the plurality of second cavities comprise at least one second cavity having a second surface turn on the second mating surface to direct flow to turn at an angle along the second surface turn.

9. The mixing apparatus of claim 8 wherein the first mating surface and the second mating surface are generally planar.

10. The mixing apparatus of claim 8 wherein the first regions of shallow depth of the first mating surface and the second regions of shallow depth being staggered along the internal flow path at substantially regular intervals.

11. The mixing apparatus of claim 8 wherein the first regions of shallow depth of the first mating surface of the first shell overlap with the second cavities of the second shell, and the second regions of shallow depth of the second mating surface of the second shell overlap with the first cavities of the first shell.

12. The mixing apparatus of claim 11 wherein the first regions of shallow depth comprise first regions of zero depth and the second regions of shallow depth comprise second regions of zero depth, such that the first regions of zero depth of the first mating surface of the first shell overlap with the second cavities of the second shell, and the second regions of zero depth of the second mating surface of the second shell overlap with the first cavities of the first shell.

13. The mixing apparatus of claim 8 wherein the first surface turn is about 90° and the second surface turn is about 90°.

14. A method of making a mixing apparatus for mixing a flowable material, the method comprising:

providing a first body having a first mating surface and a plurality of first cavities formed on the first mating surface, the plurality of first cavities being arranged along a first path to provide a variation in depth measured from the first mating surface;

providing a second body having a second mating surface configured to mate with the first mating surface of the first body, the second body including a plurality of second cavities formed on the second mating surface, the plurality of second cavities being arranged along a second path to provide a variation in depth measured from the second mating surface; and mating the first mating surface of the first body with the second mating surface of the second body to align the first path with the second path, the first cavities fluidicly communicating with the second cavities to form an internal flow path from an inlet through the first cavities and second cavities to an outlet, the internal flow path having multiple depth turns to direct flow between the first body and the second body formed by the depth variations in the first cavities of the first body and the second cavities in the second body;

wherein the first cavities are spaced from each other along the first path by first regions of zero depth measured from the first mating surface;

wherein the second cavities are spaced from each other along the second path by second regions of zero depth measured from the second mating surface; and wherein the plurality of first cavities comprise at least one first cavity having a first surface turn on the first mating surface to direct flow to turn at an angle along the first surface turn, and wherein the plurality of second cavities comprise at least one second cavity having a second surface turn on the second mating surface to direct flow to turn at an angle along the second surface turn.

15. The method of claim 14 wherein mating comprises bonding the first mating surface with the second mating surface.

16. The method of claim 14 wherein the multiple depth turns are spaced by substantially regular intervals.

17. The method of claim 14 wherein the first body and the second body are formed by molding.

18. The method of claim 14 wherein the first surface turn is about 90° and the second surface turn is about 90°.

19. The method of claim 14 wherein the first mating surface and the second mating surface are generally planar.

20. The method of claim 14 wherein the first regions of zero depth of the first path and the second regions of zero depth of the second path are staggered along the continuous internal flow path, such that the first regions of zero depth of the first path of the first body overlap with the second cavities of the second body, and the second regions of zero depth of the second path of the second body overlap with the first cavities of the first body.

* * * * *